US005390688A

United States Patent [19]

Lipman

[11] Patent Number: 5,390,688

[45] Date of Patent: Feb. 21, 1995

[54] SHELTER FOR VEHICLES

[76] Inventor: Stuart M. Lipman, 7127 Third Ave. South, St. Petersburg, Fla. 33707

[21] Appl. No.: 957,691

[22] Filed: Oct. 7, 1992

[51] Int. Cl.[6] ..... E04B 1/342

[52] U.S. Cl. ..... 135/97; 135/135

[58] Field of Search ..... 135/97 OR, 101, 102, 135/104; 52/79.4, 80.1, 82

[56] References Cited

U.S. PATENT DOCUMENTS

| | | | |
|---|---|---|---|
| 2,520,055 | 8/1950 | Powerance | 135/97 |
| 2,556,617 | 6/1951 | Harrah | 135/97 |
| 2,880,741 | 4/1959 | McGrand | 135/97 |
| 3,270,755 | 9/1966 | Horvath | 135/97 |
| 3,353,310 | 11/1967 | Ruhle | 52/66 |
| 3,690,078 | 9/1972 | Maynard, Jr. | 135/102 |
| 3,856,029 | 12/1979 | Huddle | 135/102 |
| 4,008,730 | 2/1977 | Keklak et al. | 135/97 |
| 4,414,993 | 11/1983 | Gillis | 135/104 |
| 4,557,284 | 12/1985 | Bray | 135/97 |
| 4,832,067 | 5/1989 | Felber | 135/102 |

*Primary Examiner*—Carl D. Friedman
*Assistant Examiner*—Wynn E. Wood
*Attorney, Agent, or Firm*—Michael J. Coltitz, Jr.

[57] ABSTRACT

The invention relates to a semipermanent shelter for airplanes comprising a plurality of vertical wall tubes, each having an upper end and a lower end removably securable to the ground; a plurality of roof tubes each having an interior end and an exterior end, located adjacent to the upper end of an associated wall tube at a juncture; a central bracket coupling the interior ends of the roof tubes at a central, upper portion of the shelter; a plurality of central tubes in a generally horizontal configuration coupling each juncture with its next adjacent junction except across an opening of the shelter; an arch tube coupling adjacent junctures at the opening of the shelter and constituting the upper extent of such opening; a plurality of side brackets, each coupling a wall tube and its associated roof tube with the central tubes and the arch tube; and sheet material coupled to the roof tubes, central tubes and arch tube for sheltering an airplane therebeneath.

13 Claims, 5 Drawing Sheets

SHELTER FOR VEHICLES

BACKGROUND OF THE INVENTION

1. Field of the Invention

The present invention relates to a shelter for vehicles and, more particularly, to a semipermanent airplane shelter comprising a frame, flexible sheet material stretched over at least the top of the frame, and a security member for opening and closing the shelter.

2. Description of the Background Art

Airplanes are expensive and their electronic systems are sensitive to light and heat. To prevent damage, the airplane should be sheltered from direct sunlight, adverse weather and airborne contaminants. However, due to the unavailability or high cost of shelter space in permanent airplane hangars, many small private airplane are parked outdoors unsheltered.

There has thus always been a need for inexpensive semipermanent structures to shelter airplanes. In their simplest form, semipermanent structures generally comprise support posts, rigidly mounted in the ground. A tubular framework is somehow connected to the support posts, and a fabric cover is tensioned over the tubular framework. A variety of structures has been developed to suit particular perceived needs. From a review of the known structures, it can be seen that any improvement in structural integrity has been gained at the expense of ease of manufacture, erection, disassembly, transportation, convenience and cost. As yet, no structure has been developed which is simple in design, unobtrusive, easily assembled, and aesthetically appealing, and at the same time is capable of providing a full, lockable enclosure capable of withstanding moderate wind and snow at low cost and high convenience.

For example, U.S. Pat. No. 3,270,755 to Horvath and U.S. Pat. No. 2,556,617 to Harrah show shelters comprising intricate framework structures rigidly anchored to the ground. Horvath teaches an intricate framework which supports both a roof and rigid sidewalls. Harrah discloses a transverse T-shaped structure which incorporates a plurality of curved, rib-like members that are supported between the ground and horizontal beams. A fabric cover is stretched across this framework to form the shelter. The elaborate construction is tailored to a single airplane design and can not accommodate a variety of airplane. The structure also does not provide a lockable barrier to egress.

U.S. Pat. No. 2,520,055 to Pomerance, U.S. Pat. No. 2,880,741 to McGrand and U.S. Pat. No. 4,008,730 to Keklak teach shelters which are supported by a cable tensioning system in combination with rigidly anchored vertical posts. Pomerance teaches a T-shaped structure comprising four corner posts and a ground-anchored cable system which supports a shelter covering both the roof and sidewalls. McGrand teaches a structure which is triangular in shape and supports a cover forming both a roof and sidewalls. This cover is held by tensioned cables which extend over three corner posts and which are anchored in the ground. The shelter described in Keklak consists of fabric sheets stretched over a rigid framework extending in a horizontal plane. This shelter is held above the ground by means of cables depending from three vertical posts. A cable-tensioning system extends outward from the shelter, tending to preclude the placing of such structures in close proximity, and providing impediments to pedestrian traffic.

Ruhle, in U.S. Pat. No. 3,353,310, teaches a T-shaped shelter which closely conforms to the shape of the sheltered airplane.

Bray, in U.S. Pat. No. 4,557,284, discloses a horizontally disposed fabric cover which generally conforms to the dimensions of the airplane to be sheltered. This fabric cover is primarily supported by an overhead horizontal boom, held by a curved central post, which extends above and in a parallel relation with the plane body. Along its periphery, the cover is stretched and tethered to four vertical corner posts. Bray uses separate vertical and horizontal support elements. Bray does not teach the provision of walls, or the provision of a lockable barrier which may be easily removed for egress of the airplane.

The known structures are all intended to be portable, stable and easily erected. However, none of the known constructions are capable of satisfying all of the demands of the consumer in a construction which is aesthetically pleasing, inexpensively manufactured and easily transported and erected and which provides security mechanisms to provide security against theft.

For example, one consideration by the consumer is that any structure which is considered permanent becomes the property of the airport and can not be removed. A structure of which the main structural elements are fixed to the ground would tend, for all practical purposes, to be considered a permanent structure.

Another consideration is securing airplane against theft. A structure which is not designed to permit full enclosure by a fabric membrane, or which does not provide a lockable barrier to egress of the airplane, would not satisfy the demands for security. Structures which have a lockable front structure which can be easily opened to a width to permit the airplane to exit and enter tend to be more permanent than semipermanent structures.

A further problem with existing small hangar-type enclosed structures is that the walls are usually as high as the highest part of the airplane. Such a shelter has a high sail area and must be of strong construction to withstand wind forces. As the design of the structure is adapted to handle higher vertical loads, the structure tends to become more complex and the fabrication thereof becomes more expensive.

As described above, it is known to enhance the structural integrity of lightweight airplane shelters with external tethers which extend beyond the periphery of the airplane shelter itself. These external tethers would prevent the placement of a number of shelters adjacent to each other in a tight pattern as may be desirable for space economy, thus reducing the number of shelters which can be placed in a given area. Further, the tethers would pose obstacles to pedestrian traffic.

As can be understood, there is an increasing need for temporary shelters which are inexpensive, aesthetically pleasing, can safely accommodate a variety of common small airplane, do a minimum of damage to the ground surface, do not pose impediments to pedestrians, and can be erected and then removed with a minimum of labor, have become increasingly desirable.

It is, therefore, an object of the present invention to provide a semipermanent shelter for airplanes comprising a plurality of vertical wall tubes, each having an upper end and a lower end removably securable to the ground; a plurality of roof tubes each having an interior end and an exterior end, located adjacent to the upper end of an associated wall tube at a juncture; a central bracket coupling the interior ends of the roof tubes at a central, upper portion of the shelter; a plurality of central tubes in a generally horizontal configuration coupling each juncture with its next adjacent junction except across an opening of the shelter; an arch tube coupling adjacent junctures at the opening of the shelter and constituting the upper extent of such opening; a plurality of side brackets, each coupling a wall tube and its associated roof tube with the central tubes and the arch tube; and sheet material coupled to the roof tubes, central tubes and arch tube for sheltering an airplane therebeneath.

It is a further object of the invention to devise a semiportable airplane shelter which provides security against theft.

It is a further object of the invention to construct a semiportable airplane shelter which does not become a permanent fixture, and can be easily disassembled and completely removed.

It is a further object of the invention to shelter airplanes in a semiportable shelter which can be erected over either tarmac or grass.

It is a further object of the invention to eliminate cables extending beyond the periphery of the walls of an airplane shelter.

It is a further object of the invention to minimize the area of semiportable airplane shelters.

It is a further object of the invention to simplify the erection and removal of a semiportable airplane shelter.

It is a further object of the invention to configure a semiportable airplane shelter to render it useful either individually or integrated with other airplane shelters of the same construction in a pattern which is both aesthetically pleasing and maximizes ground utilization.

It is yet a further object of the invention to construct a lightweight, semiportable airplane shelter which can be easily erected without special equipment, yet is capable of withstanding wind and snow loads.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention may be incorporated into a semipermanent shelter for airplanes comprising a plurality of vertical wall tubes, each having an upper end and a lower end removably securable to the ground; a plurality of roof tubes each having an interior end and an exterior end, located adjacent to the upper end of an associated wall tube at a juncture; a central bracket coupling the interior ends of the roof tubes at a central, upper portion of the shelter; a plurality of central tubes in a generally horizontal configuration coupling each juncture with its next adjacent junction except across an opening of the shelter; an arch tube coupling adjacent junctures at the opening of the shelter and constituting the upper extent of such opening; a plurality of side brackets, each coupling a wall tube and its associated roof tube with the central tubes and the arch tube; and sheet material coupled to the roof tubes, central tubes and arch tube for sheltering an airplane therebeneath.

The shelter includes seven wall tubes in a symmetric pattern. The roof tubes extend upwardly and inwardly to an apex of the shelter. The seven wall tubes include four in a rectangular configuration defining parallel walls adjacent to the tips of the wings of a sheltered aircraft, one behind the tail of a sheltered aircraft and two located therebetween. The lower ends of the sheet material are adjustably coupled to the central tubes and extend about six feet, plus or minus ten percent, from the ground. The shelter further includes securement tethers coupling the central bracket with the lower end of at least some of the side walls. The shelter may include security tether means coupled between the arch tube and the ground therebeneath or a security door positionable between a position in front of the entrance to a position remote therefrom. The security door is in a clam shell configuration with support rails with sheet material therebetween. The security door is pivotally coupled to the ground adjacent to the entrance with mechanisms to raise the door to above the entrance.

The invention may also include an array of semipermanent shelters for airplanes, each shelter comprising a plurality of vertical wall tubes, each having an upper end and a lower end removably securable to the ground; a plurality of roof tubes each having an interior end and an exterior end, located adjacent to the upper end of an associated wall tube at a juncture; a central bracket coupling the interior ends of the roof tubes at a central, upper portion of the shelter; a plurality of central tubes in a generally horizontal configuration coupling each juncture with its next adjacent junction except across an opening of the shelter; an arch tube coupling adjacent junctures at the opening of the shelter and constituting the upper extent of such opening; a plurality of side brackets, each coupling a wall tube and its associated roof tube with the central tubes and the arch tube; and sheet material coupled to the roof tubes, central tubes and arch tube for sheltering an airplane therebeneath.

The shelters may be located with their openings in alignment and adjacent shelters share at least one common wall tube or in a triangular configuration with openings facing oppositely and adjacent shelters sharing one common fixed wall tube.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
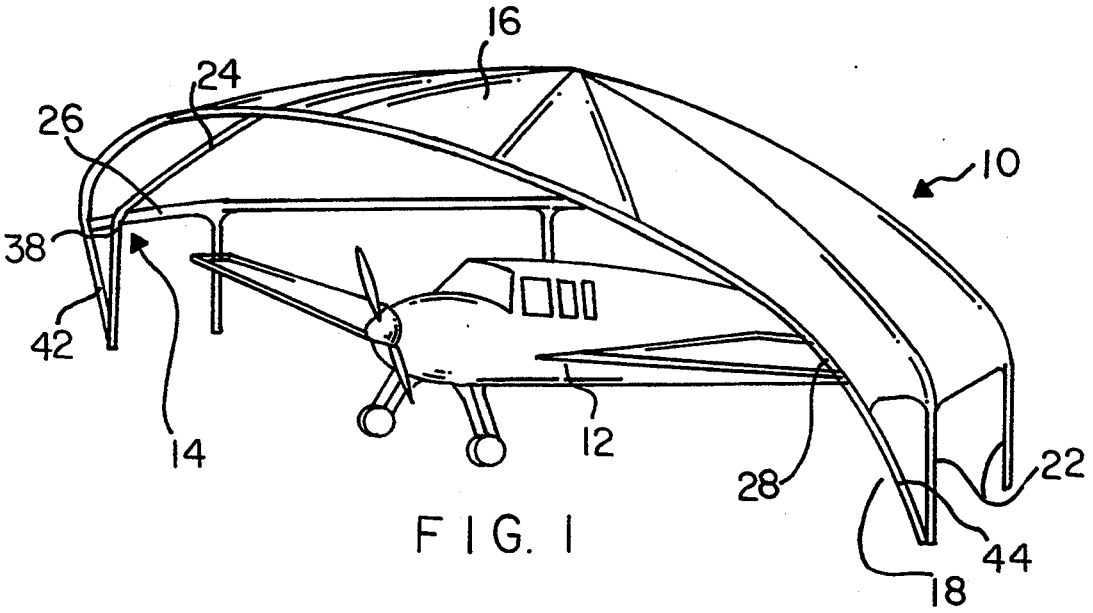
FIG. 1 is a perspective view of a shelter for an aircraft constructed in accordance with the principles of the present invention.

As can be seen in the various Figures, the present invention is embodied in semipermanent shelters 10 for airplanes 12 or like vehicles. Each shelter includes a frame assembly 14 for providing position and shape to the shelter, sheet material 16 supported by the frame to cover and shelter the airplane, and security mechanisms associated with the frame for opening and closing the shelter entrance 18 to allow an airplane to enter or leave the shelter and for securing an airplane within the shelter.

The first part of the shelter is the frame assembly 14. The frame assembly includes a plurality of elongated rods, preferably hollow tubes. The tubes include wall tubes 22, roof tubes 24, central tubes 26 and an arch tube 28. Each wall tube 22 has a free upper end and a lower end and is linear in shape. It is constructed with its lower end receivable in an upstanding projection 32 secured in the ground in a location for proper positioning of the shelter 10. Aligned apertures 34 extend through the lower end of the wall tubes 22 and the upper end of the projection 32 so that a pin 36 may be extended therethrough to preclude inadvertent lifting or other movement of the wall tube with respect to the projection and its intended location. The upper end of each wall tube terminates at a junction 38 for coupling with other components of the shelter 10.

The other major components of the frame assembly include the roof tubes 24. Each roof tube 24 extends upwardly from an associated wall tube 22 at about 6 feet from the ground and then bends inwardly to a common central point of the shelter, the apex, a point elevated with respect to the remainder of the shelter.

The third type of tubes are central tubes 26, which are located in a generally horizontal orientation. Each central tube 26 extends between junctions 38 of adjacent wall and roof tubes except across the opening or entrance 18 of the shelter for movement of the airplane to be sheltered. The wall tubes 42 and 44 at opposite side of the entrance are coupled by an arch tube 28 to provide sufficient elevation so that the airplane may move into and out of the shelter in a convenient manner without interference from the shelter.

Figure 6:
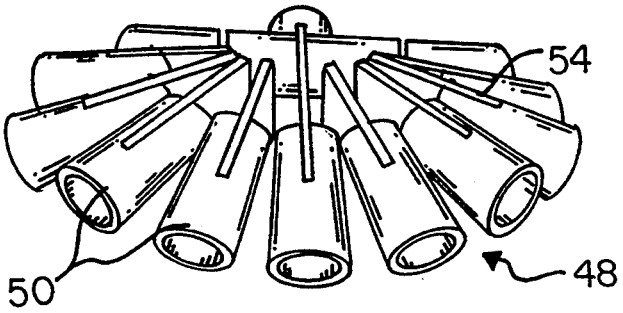
FIG. 6 and 7 illustrate a central bracket as employed in the shelter of the prior figures.
Figure 7:
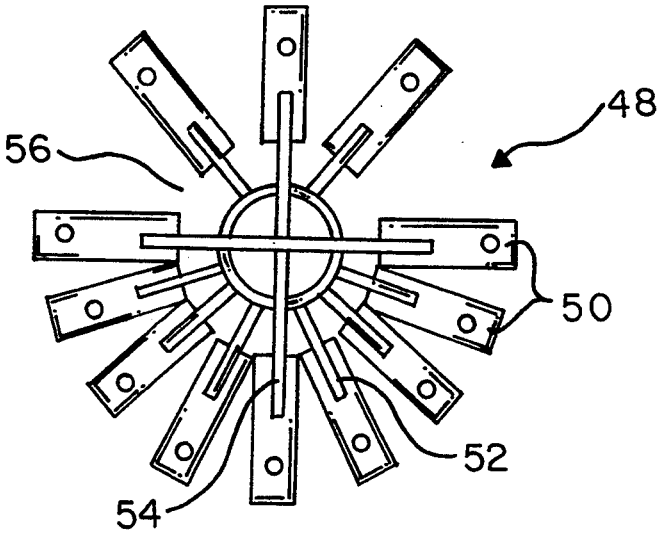

Located at the apex of the shelter and coupling interior ends of the roof tubes is a central bracket 48. This central bracket is formed of radially extending short tubes 50 adapted to receive interior ends of the roof tubes 24 as shown in FIGS. 6 and 7. Twelve such short tubes are provided to correspond with the twelve roof tubes of the shelter. Each short tube is provided with a vertical slot 52 on its radially interior end for receiving a vertically extending support plate 54. The support plates are coupled together at a central hub 56 to provide permanent positioning for the short tubes and, hence, the roof tubes, one with respect to the other.

Figure 8:
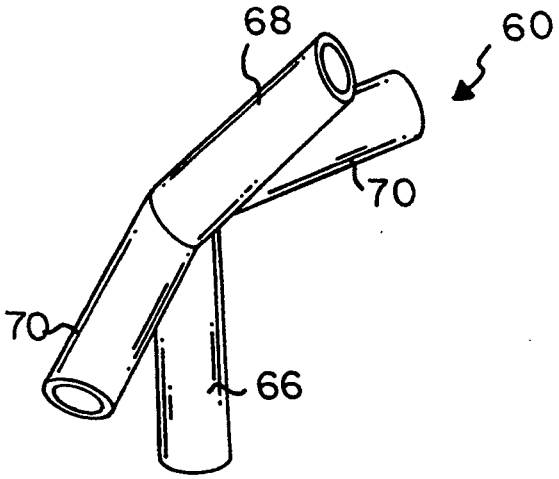
FIGS. 8 and 9 illustrate side brackets as employed in the structure of the prior figures.
Figure 9:
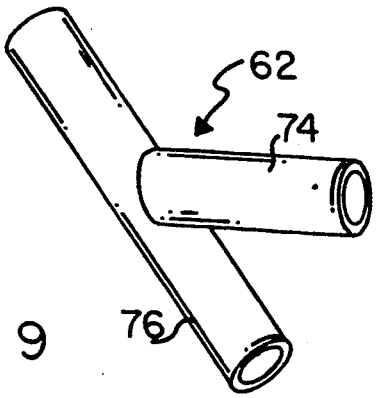

Additional hardware for providing support and positioning of the various tubes are the junction brackets 60 and 62. Note FIGS. 8 and 9. There is a junction bracket provided at the exterior end of each roof tube for coupling with the upper end of each wall tube. Hence, the five junction brackets 60 at the rearward extent of the shelter 66 have a downwardly extending short tube 66 for receiving an upper extent of a wall tube, an upwardly and inwardly extending short tube 68 for receiving its associated roof tube and two laterally extending short tubes 70 for receiving adjacent central tubes. The junction brackets 62 supporting the arch tube 28 at the opening or forward end of the shelter simply have a lesser number of short tubes for effecting the appropriate coupling. In the FIG. 9 illustration, each junction bracket 62 consequently has an upwardly and downwardly extending short tube 74 and 76 but only one laterally extending short tube 78 for coupling with but one central tube.

It should be understood that each tube, whether a wall tube, a roof tube, a central tube or an arch tube may be constructed as a single piece or as a series of smaller tube segments which may be coupled together.

In the preferred geometry and configuration for each shelter 10, four of the junctures of the roof tubes and wall tubes, define spaced parallel walls 82 for receiving the tips of the wings of the sheltered airplane 10. One rearwardly extending wall tube 84 and its associated roof tube is located behind the tail of the airplane while two intermediate wall tubes 86 and their associated roof tubes are located therebetween. The remaining roof tubes merely support the arch tube and define the entrance.

The material 16 covering the tube assembly is of any convenient lightweight and waterproof material. Plastic sheet material such as a vinyl is preferred but a canvas or like nonsynthetic material coated with a waterproof substance could readily be utilized. The sheet material may be of a one-piece construction but is preferably formed of plural pieces properly shaped and coupled together. Securement between the sheet material and the tube is effected at the lower edges of the sheet material where it is coupled to the central tubes. Coupling is preferably attained through the use of straps 90 and 92 coupled to the sheet material adjacent to the central tubes at the ends of the associated central tube and at a central location therebetween. Any number of similar straps preferably symmetrically located along an associated central tube could be utilized. Coupling is made through the strap having two ends, one with a buckle 94 to thereby affect appropriate tensioning of the straps and sheet material to the central tubes and to the frame structure generally. The arrangement for coupling the sheet material to the frame assembly allows for a quick and simple removal of the sheet material from the support assembly. This is significant for circumstances when heavy winds unexpectedly arise and the sheet material must be promptly removed in order to preclude damage.

Additional securement to the structure is effected by a plurality of securement tethers 98. The tethers preferably extend in the form of cables, synthetic ropes or the like, from the central bracket 48 downwardly to the base of four wall tubes, the two wall tubes immediately behind the wings of the sheltered airplane. Such an arrangement will maintain the apex of the structure secured with respect to the bases of the wall tubes for structural integrity in the event of high wind conditions or the like.

Figure 4:
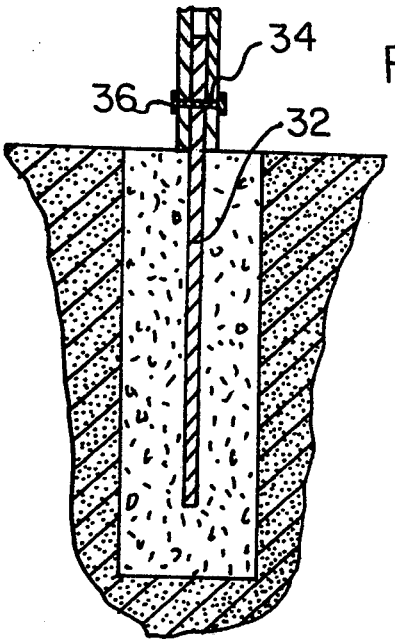
FIG. 4 illustrates the support of the lower ends of the wall tubes in the ground.
Figure 5:
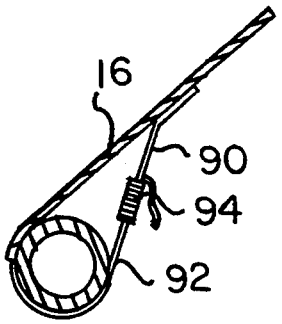
FIG. 5 illustrates the coupling of the sheet material to the tubes of the shelter.

In order to preclude inadvertently removal of an airplane from the shelter, security devices are provided. In the preferred embodiment as shown in FIGS. 1 through 9 as well as FIGS. 10 and 11, the security device is in the form of a tether or tethers 102. Such security tethers 102 extend downwardly from the central and spaced regions of the arch tube 28 to which they are coupled. They extend downwardly and are coupled through an appropriate key lock or combination lock or the like. Coupling is through an eyebolt 104 extending upwardly from the ground adjacent the entrance of the shelter. Such eyebolts are secured in a manner similar to the upward projections 32 as shown in FIG. 4.

Figure 13:
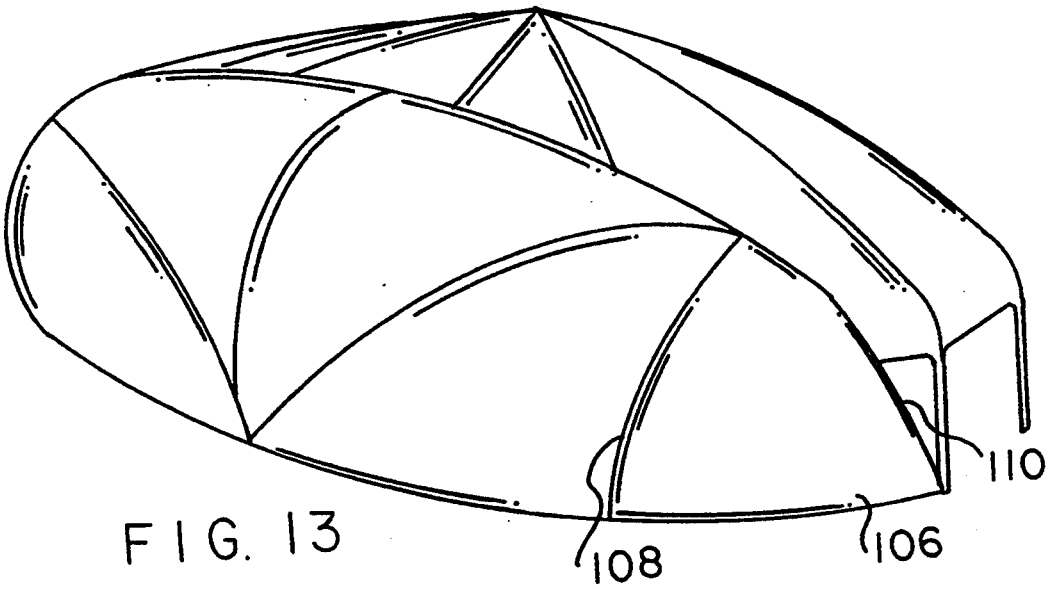
FIGS. 13, 14 and 15 include a perspective illustration as well as side elevational views of an alternate embodiment of the invention with a security door which may be used in association with the shelter of the prior embodiments.
Figure 14:
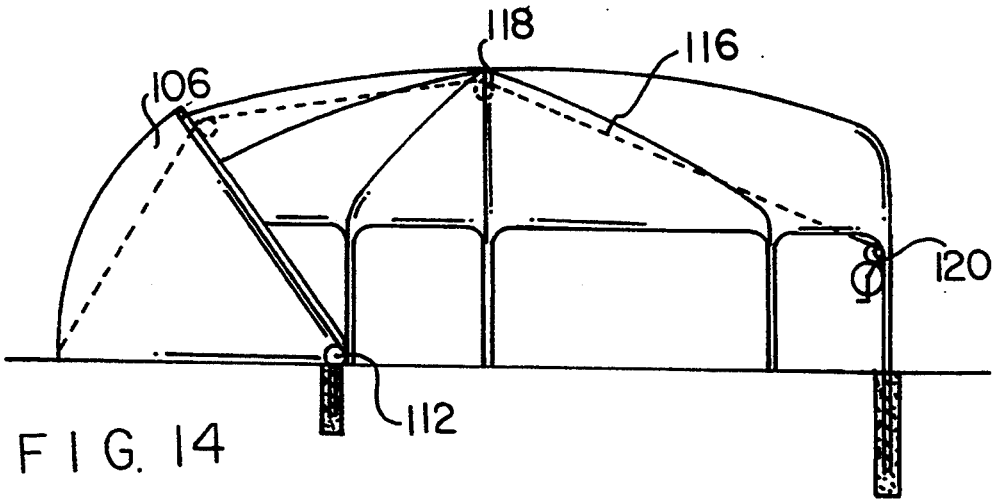
Figure 15:
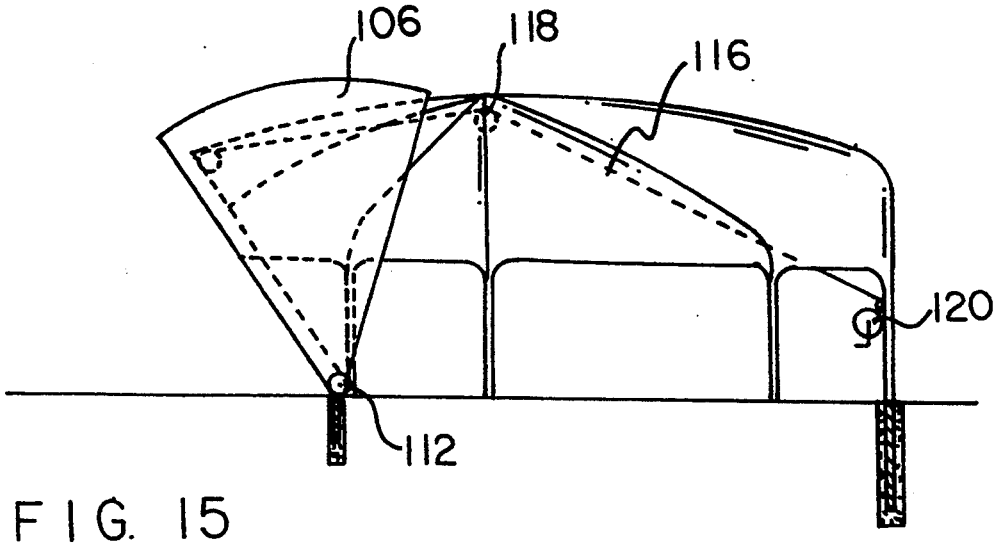

In an alternate embodiment of the invention, as shown in FIGS. 13, 14 and 15. This security device is in the form of a door 106. The door is of a clam shell configuration with support tubes 108 maintaining a fabric face in appropriate outwardly bowed configuration. Triangular side support tubes 110 meet at a pivot point 112 where they are pivotally coupled to pivot members secured to the ground adjacent the lateral edges of the opening. The sides of the side tubes of the door are in an isosceles triangular configuration with the fabric forming the wall remote from the pivot point. Movement of the door is from a lowered orientation covering the entrance, FIG. 14, to an elevated location, FIG. 15, above the fixed portion of the shelter. Movement is effected through a cable 116 coupling the lower portion of the door. The cable extends around a pulley 118 at the lower extent of the central bracket to a location adjacent the rear of the shelter. At such remote location, mechanisms 120 are provided for rolling of the cable to lift the door. Such mechanisms may be a hand winch or a power-driven motor under the control of an operator.

Figure 12:
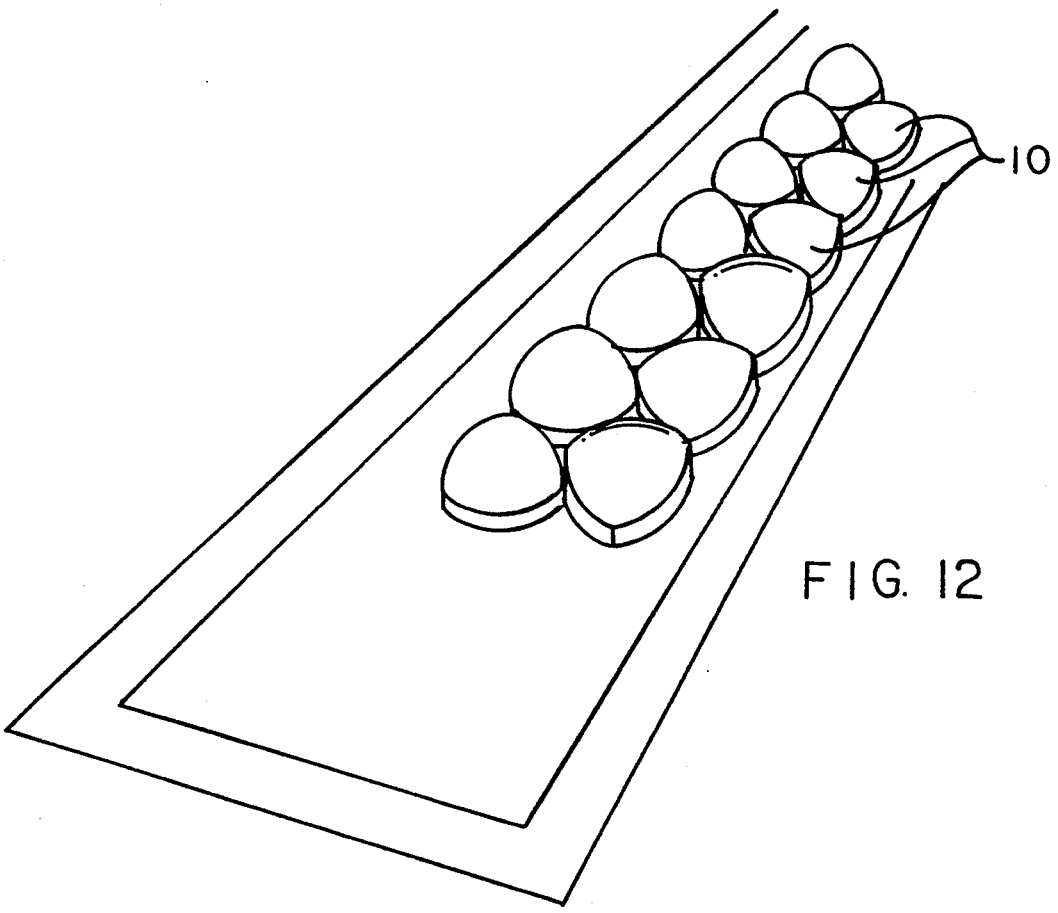
FIGS. 10, 11 and 12 are plan and perspective views of a plurality of shelters coupled together for operation and use.
Figure 2:
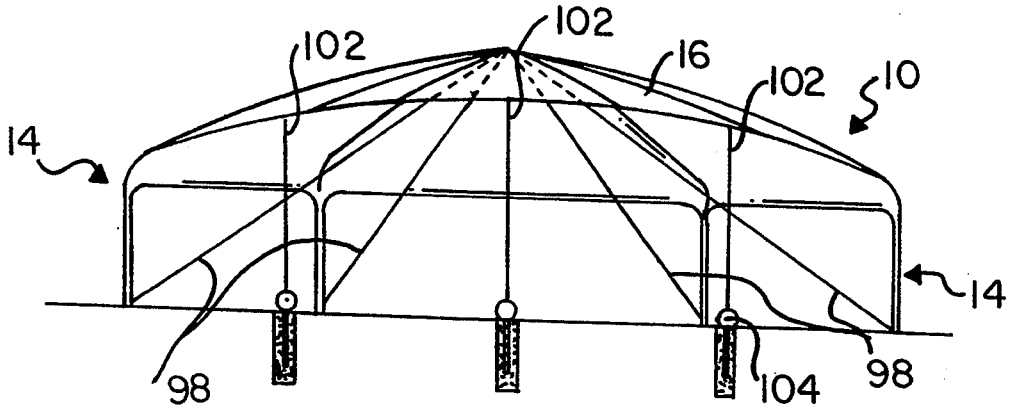
FIGS. 2 and 3 are front and side elevational views of the shelter of FIG. 1.
Figure 3:
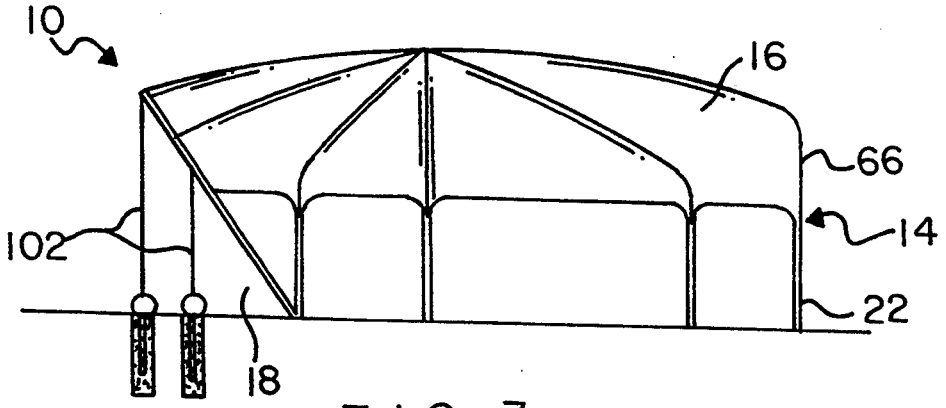
Figure 10:
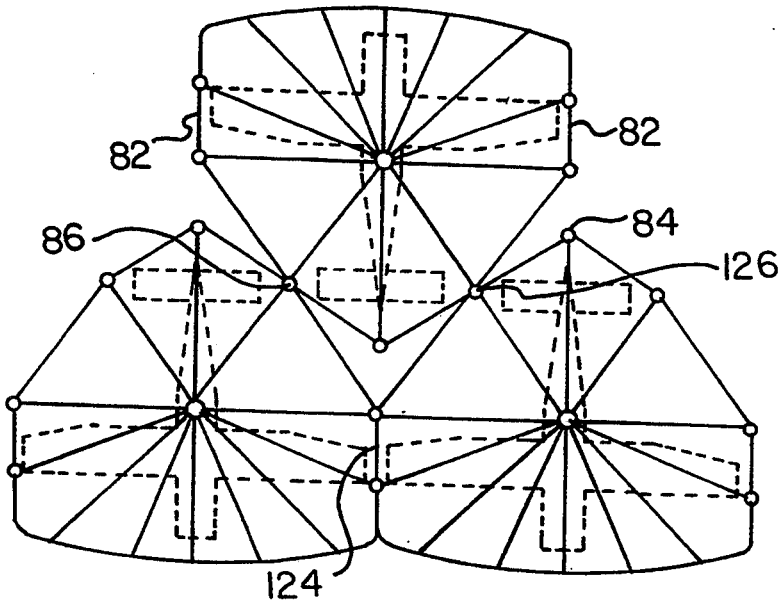
Figure 11:
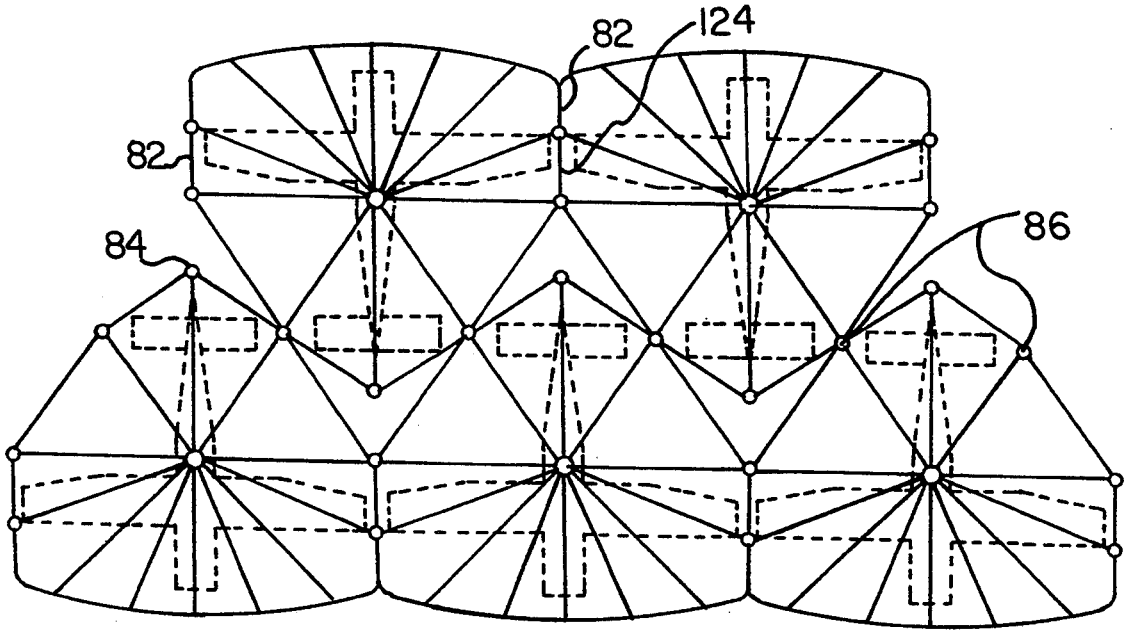

In the embodiments of FIGS. 10, 11 and 12, an array of shelters are coupled for plural airplanes, three shelters and airplanes for FIG. 10, five shelters and airplanes for FIG. 11 and a larger number in FIG. 12. In such embodiments, each shelter comprise a plurality of vertical wall tubes as in the primary embodiment but with at least one fixed wall tube, preferably two or three being common to an adjacent shelter or shelters. In the side-by-side shelters, the openings are in alignment with laterally adjacent shelters sharing two common wall tubes at the locations 124 adjacent to the tips of the airplane wings. When the shelters are in a triangular configuration, their openings are facing oppositely, and adjacent shelters share one intermediate wall tube 126. At areas where shelters share a common wall tube, the associated junction bracket is provided with an extra short tube to accommodate two roof tubes, one for each of the joined shelters.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A semipermanent shelter for airplanes comprising:

a plurality of vertical wall tubes, each having an upper end and a lower end removably securable to the ground;

a plurality of roof tubes each having an interior end and an exterior end, located adjacent to the upper end of an associated wall tube at a juncture;

a central bracket coupling the interior ends of the roof tubes at a central, upper portion of the shelter;

a plurality of central tubes in a generally horizontal configuration coupling each juncture with its next adjacent junction except across an opening of the shelter;

an arch tube coupling adjacent junctures at the opening of the shelter and constituting the upper extent of such opening;

a plurality of side brackets, each coupling a wall tube and its associated roof tube with the central tubes and the arch tube; and sheet material coupled to the roof tubes, central tubes and arch tube for sheltering an airplane therebeneath.

2. The shelter as set forth in claim 1 wherein there are seven wall tubes in a symmetric pattern.

3. The shelter as set forth in claim 1 wherein the roof tubes extend upwardly and inwardly to an apex of the shelter.

4. The shelter as set forth in claim 3 whereas the seven wall tubes include four in a rectangular configuration defining parallel walls adjacent to the tips of the wings of a sheltered airplane, one behind the tail of a sheltered airplane and two located therebetween.

5. The shelter as set forth in claim 1 wherein the lower ends of the sheet material are adjustably coupled to the central tubes and extend about six feet, plus or minus ten percent, from the ground.

6. The shelter as set forth in claim 1 and further including securement tethers coupling the central bracket with the lower end of at least some of the side walls.

7. The shelter as set forth in claim 1 and further including security tether means coupled between the arch tube and the ground therebeneath.

8. The shelter as set forth in claim 1 and further including a security door positionable between a position in front of the entrance to a position remote therefrom.

9. The shelter as set forth in claim 8 wherein the security door is in a clam shell configuration with support rails with sheet material therebetween.

10. The shelter as set forth in claim 9 wherein the security door is pivotally coupled to the ground adjacent to the entrance with mechanisms to raise the door to above the entrance.

11. An array of semipermanent shelters for airplanes, each shelter comprising:

a plurality of vertical wall tubes, each having an upper end and a lower end removably securable to the ground;

a plurality of roof tubes each having an interior end and an exterior end, located adjacent to the upper end of an associated wall tube at a juncture;

a central bracket coupling the interior ends of the roof tubes at a central, upper portion of the shelter;

a plurality of central tubes in a generally horizontal configuration coupling each juncture with its next adjacent junction except across an opening of the shelter;

an arch tube coupling adjacent junctures at the opening of the shelter and constituting the upper extent of such opening;

a plurality of side brackets, each coupling a wall tube and its associated roof tube with the central tubes and the arch tube; and sheet material coupled to the roof tubes, central tubes and arch tube for sheltering an airplane therebeneath.

12. The array as set forth in claim 11 wherein the shelters are located with their openings in alignment and adjacent shelters share at least one common wall tube.

13. The array as set forth in claim 11 wherein the shelters are located in a triangular configuration with openings facing oppositely and adjacent shelters sharing one common fixed wall tube.

* * * * *